United States Patent [19]

Talend

[11] Patent Number: 4,695,115

[45] Date of Patent: Sep. 22, 1987

[54] TELEPHONE CONNECTOR WITH BYPASS CAPACITOR

[75] Inventor: Donald R. Talend, Wauconda, Ill.

[73] Assignee: Corcom, Inc., Libertyville, Ill.

[21] Appl. No.: 901,824

[22] Filed: Aug. 29, 1986

[51] Int. Cl.[4] ..... H01R 13/66

[52] U.S. Cl. ..... 439/76; 333/184; 439/607; 439/676

[58] Field of Search ..... 333/181, 182, 183, 184, 333/185; 339/143 R, 147 R, 147 P, 176 M, 14 R

[56] References Cited

U.S. PATENT DOCUMENTS

| | | | |
|---|---|---|---|
| 3,369,214 | 2/1968 | Krumreich et al. | 339/105 |
| 3,699,498 | 10/1972 | Hardesty et al. | 339/99 R |
| 3,761,869 | 9/1973 | Hardesty et al. | 339/99 R |
| 3,954,320 | 5/1976 | Hardesty | 339/99 R |
| 4,054,350 | 10/1977 | Hardesty | 339/99 R |
| 4,538,874 | 9/1985 | Dambach et al. | 339/99 R |
| 4,572,600 | 2/1986 | Nieman | 339/147 R |
| 4,580,866 | 4/1986 | Hagner | 339/147 R |
| 4,582,385 | 4/1986 | Couper et al. | 339/147 R |
| 4,600,256 | 7/1986 | Anttila | 339/147 R |

*Primary Examiner*—Gil Weidenfeld
*Assistant Examiner*—Gary F. Paumen
*Attorney, Agent, or Firm*—Hill, Van Santen, Steadman & Simpson

[57] ABSTRACT

A modular jack for telephones in which bypass capacitors have been connected to the leads so as to bypass noise and other high frequency signals. End mounted ceramic capacitors extend from the leads to a ground plane which is provided with flexible fingers and which is connected to a suitable ground so as to provide a grounding contact for the capacitors.

9 Claims, 9 Drawing Figures

TELEPHONE CONNECTOR WITH BYPASS CAPACITOR

BACKGROUND OF THE INVENTION

1. Field of the Invention

This invention relates in general to electrical contacts in jacks and in particular to a novel modular telephone jack in which the contacts are provided with bypass capacitors.

2. Description of the Prior Art

Standard modular telephone jacks are provided with a number of electrical contacts such as six, eight or more which make mating engagement with a male contact which is received therein. Such prior art jacks do not provide bypass capacitors to a ground plane from the various contacts.

SUMMARY OF THE INVENTION

It is an object of the present invention to provide end mounted ceramic capacitors (tombstone capacitors) which extend between the contacts and a ground plane of the jack.

It is an object of the present invention to provide a telephone female terminal in which the various contacts of the terminal are provided with an enlarged portion upon which are mounted monolithic surface mounted capacitors which extend to a ground plane which is connected to a ground plane of a printed circuit board or to another suitable grounding region.

Metal springs are provided which engage the ends of the capacitors which provide for mechanical cushioning of the capacitors and for alignment.

Other objects, features and advantages of the invention will be readily apparent from the following description of certain preferred embodiments thereof taken in conjunction with the accompanying drawings, although variations and modifications may be effected without departing from the spirit and scope of the novel concept of the disclosure and in which:

DESCRIPTION OF THE PREFERRED EMBODIMENTS

Figure 1:
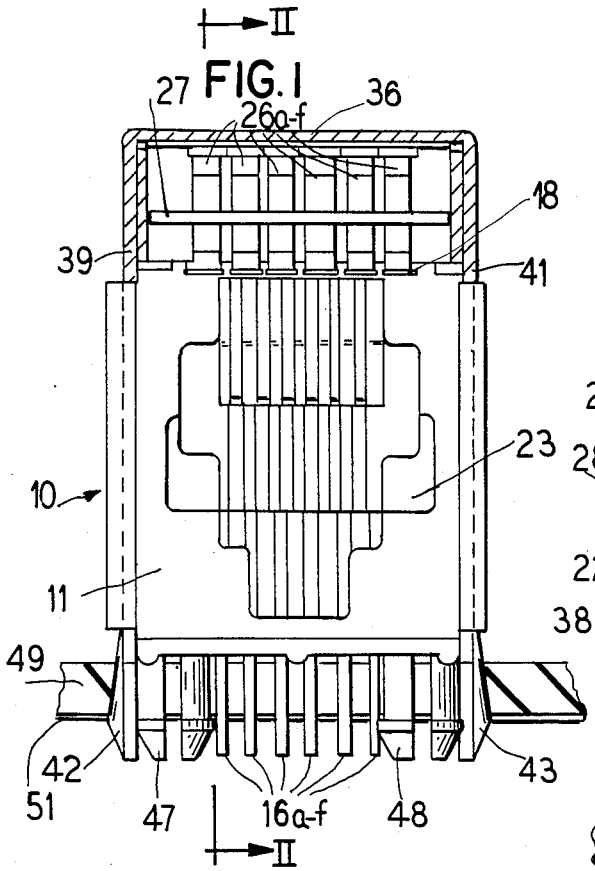
FIG. 1 is a front plan view of the novel connector of the invention.
Figure 2:
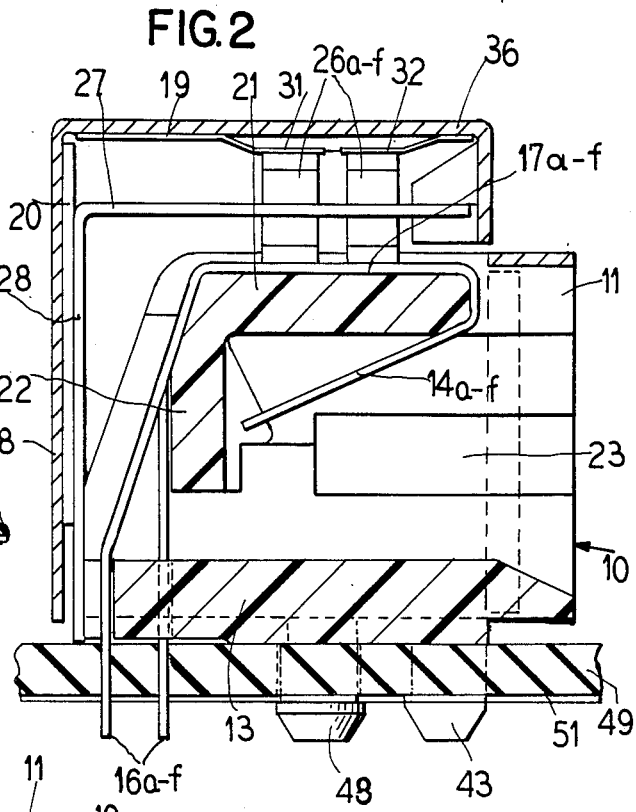
FIG. 2 is a sectional view taken on line II—II from FIG. 1.
Figure 3:
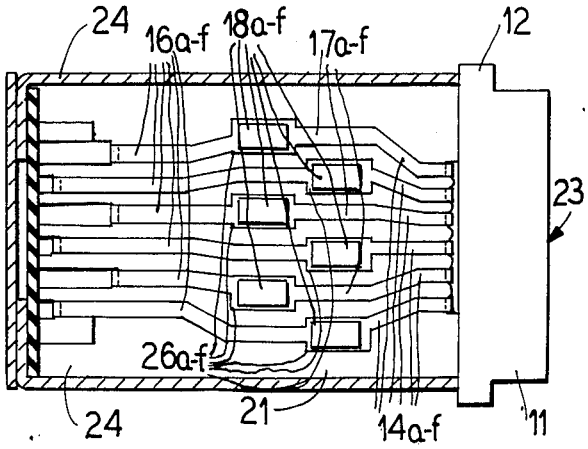
FIG. 3 is a top plane view of the invention with portions removed.
Figure 6:
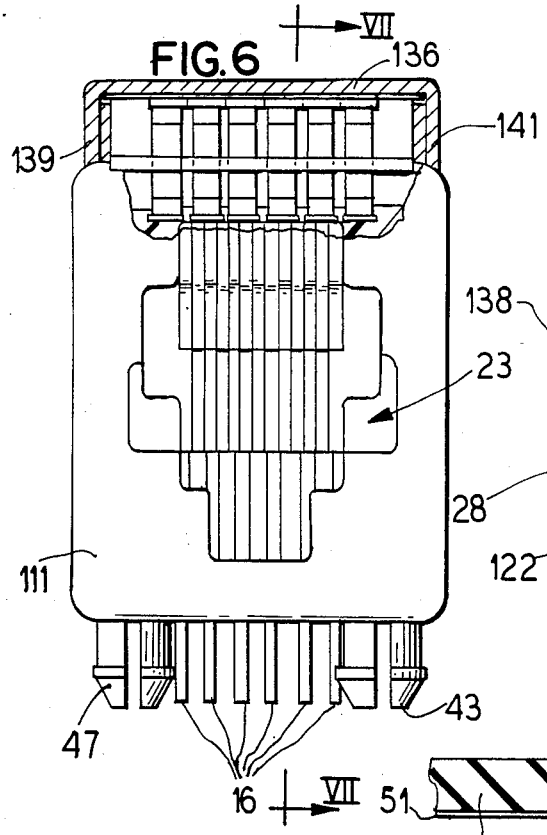
FIG. 6 illustrates a modification of the invention.

FIGS. 1–5 illustrate a first embodiment of the invention which comprises a terminal 10 formed with a plastic body member 11 in which a jack receiving hole 23 is formed in a front face thereof. The plastic member as shown in the sectional view of FIG. 2 has a bottom member 13 and a top member 21 and a back portion 22. A plurality of electrical contact members 14*a* through 14*f* have first portions which extend into the opening 23 so as to make electrical contact with mating terminals on a male plug received in the opening 23 and have top portions 17*a* which pass over the top 21 of the plastic member 11 and are formed with enlarged capacitor contacts 18*a* through 18*f* in the top portions 17*a* through 17*f* of the contact which are offset relative to each other as illustrated in FIG. 3. The rear portions of the contacts 14*a* through 14*f* pass down beyond the rear portion 22 of the plastic member 11 and extend through the bottom portion 13 of the plastic member 11 and through a printed circuit board 49 which is provided with printed circuit contact area 51 to make electrical contact with the ends 16*a* through 16*f* of the contacts 14*a* through 14*f* as illustrated in FIGS. 1 and 2, for example.

Mounting prongs 47 and 48 pass through aligned openings in the printed circuit board 49 for mounting the female contact 10 on the board 49. A plurality of end mounted capacitors 26*a* through 26*f* extend through an insulating sheet 27 which has a rear portion 28 which is mounted relative to the plastic housing 11 such that first ends of the capacitors 26*a* through 26*f* engage the electrical contact regions 18*a* through 18*f* of the electrical contacts 14*a* through 14*f*.

Figure 4:
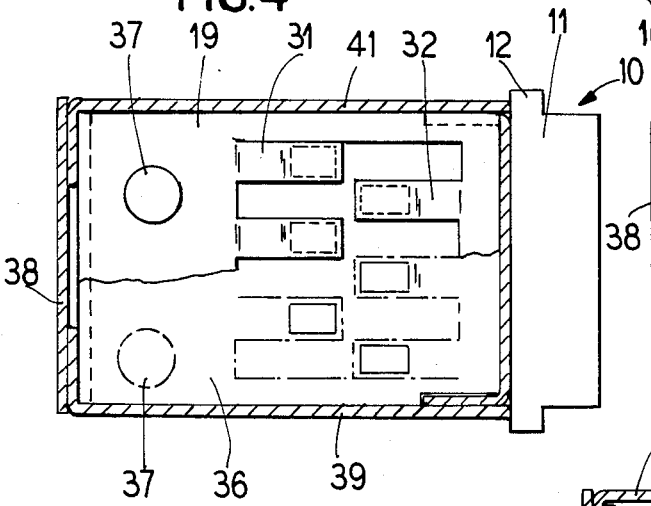
FIG. 4 is a cut-away top view of the invention.

A planar member 19 is formed with downwardly bent fingers such as 31 and 32 illustrated in FIGS. 2 and 4 which engage the second ends of the tombstone capacitors 26*a* through 26*f* and the member 19 is electrically connected to a conductive core 36. A downwardly extending portion 20 of cover 36 is mounted between downwardly extending portion 28 of the insulating member 27 and the rear 38 of the electrical conducting cover member 36. The member 19 may be soldered to the cover member 36 by providing solder through holes 37 formed in the finger member 19 as illustrated in FIG. 4.

The cover member 36 is formed with sides 39 and 41 and grounding tabs 42 and 43 which extend from the cover member 36 through openings formed in the printed circuit board 49 and make electrical contact with grounding regions on the printed circuit 51 so as to ground the upper ends of the capacitors 26*a* through 26*f* through the fingers 31 and 32, the finger member 19 and the cover member 36.

Figure 5:
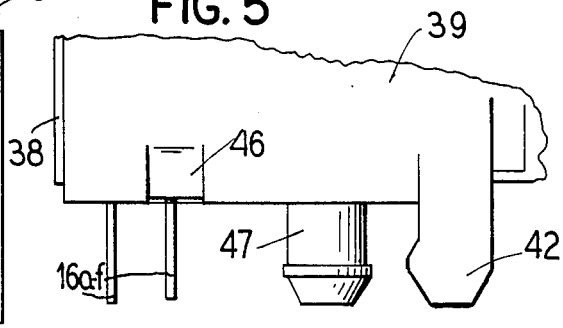
FIG. 5 is a partial view illustrating the connector prongs and contacts.

In use, the terminal 10 is mounted on a printed circuit board 49 with contacts 16*a* through 16*f* which extend through board 49 electrically connected to different terminals on the printed circuit paths 51. The other ends of the capacitors 26*a* through 26*f* are grounded through the grounding tabs 42 and 43 which are connected to the side walls 39 and 41 of the electrically conducting cover member 36. The male member of the connector is inserted into the opening 23 to make electrical connection between the terminals 14*a* through 14*f* and such contacts are grounded through the capacitors 26*a* through 26*f*. As illustrated in FIG. 5, the cover member side walls 39 and 41 are provided with tabs 46 which are deflected into mating opening formed in the plastic member 11 to firmly attach the cover member 36 to the plastic body member 11.

FIGS. 6–9 illustrate a second embodiment of the invention wherein grounding is made to a front grounding plate rather than to the printed circuit board 49.

Figure 7:
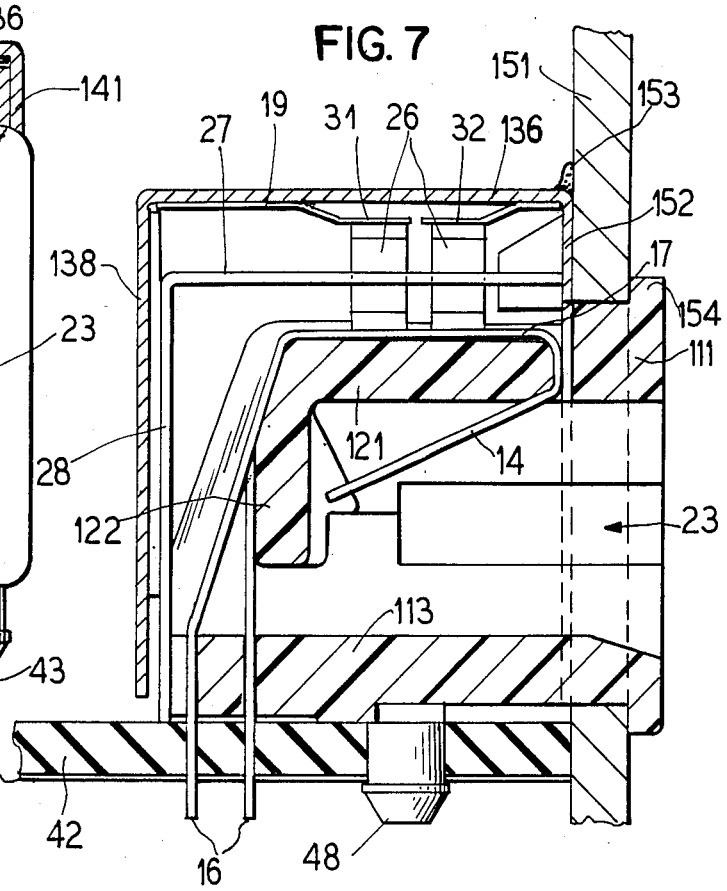
FIG. 7 is a sectional view taken on line VII—VII from FIG. 6.
Figure 9:
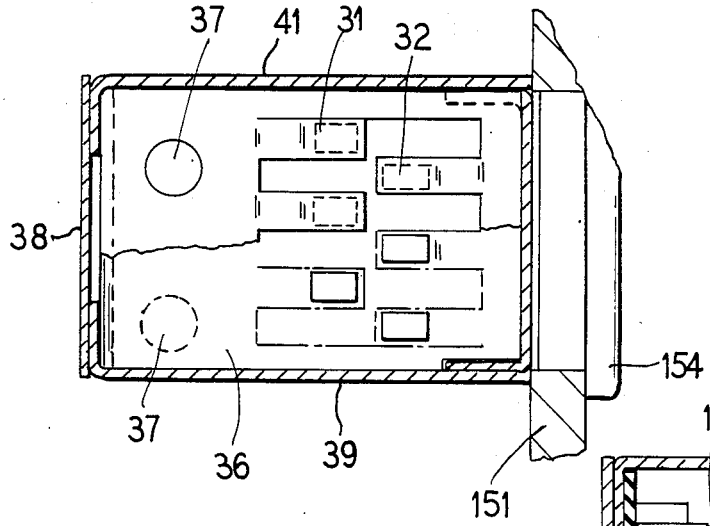
FIG. 9 is a break-away top view of the invention.
Figure 8:
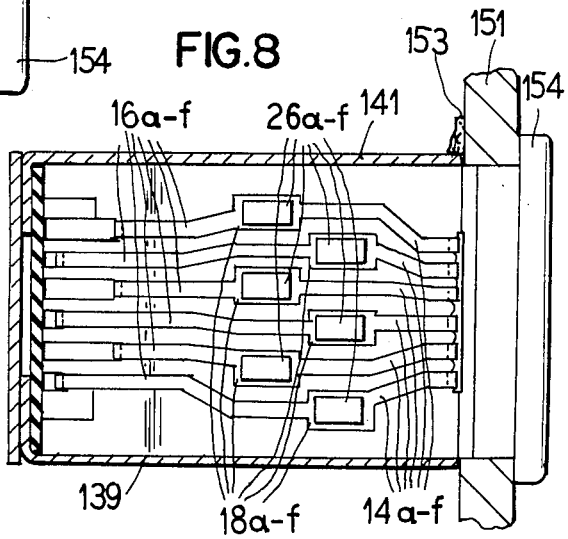
FIG. 8 is a top plan view with portions removed.

FIGS. 6-9 illustrate a modification of the invention wherein the grounding arrangement has been changed. This merely requires the modification of the cover member and the plastic body member. In this embodiment, the cover member 136 has a front portion 152 which is connected to a conductive planar member 151 by solder 153. The plastic member 111 has a front rim 154 behind which the electrical conductive planar member 151 fits as shown in FIGS. 7, 8 and 9. The terminals 14*a* through 14*f*, the insulating plate 27, the capacitors 26 have the same configuration as that of the first embodiment. The cover member 136 is modified so as to eliminate the extension tabs 42 and 43 which are used for grounding in the embodiment illustrated in FIGS. 1–5 and grounding occurs through the plate 151 which is connected by the solder 153 to the cover member 136. This embodiment allows mounting and grounding to conductive back panel.

Although the invention has been shown with six electrical terminals, it is to be realized that it may be modified to any desired number such as 8 or 10, for example. Item 12 of FIG. 3 (flangeless) could be modified as item 154 of FIG. 8 (flanged) with or without 151 conductive mounting member.

Although the invention has been described with respect to preferred embodiments, it is not to be so limited as changes and modifications can be made which are within the full intended scope of the invention as defined by the appended claims.

I claim as my invention:

1. A modular telephone jack comprising an insulating body member formed with an opening for a mating connector, a plurality of electrical contacts mounted in said body member, a plurality of surface mounted tombstone capacitors with first ends in contact, respectively, with said plurality of electrical contacts, an electrically conducting planar member mounted to said body member and formed with a plurality of flexible fingers, respectively, engaged by the second end of said plurality of tombstone capacitors, and means for grounding said electrically conducting planar member.

2. A telephone jack according to claim 1 including an electrically conducting cover member mounted to said body member over said electrically conducting planar member and electrically connected to said planar member.

3. A telephone jack according to claim 2 wherein said plurality of tombstone capacitors are mounted so that their longitudinal axes extend parallel to each other.

4. A telephone jack according to claim 3 wherein said electrically conducting planar member is soldered to said electrically conducting cover member.

5. A telephone jack according to claim 3 including an electrically insulating member formed with a plurality of holes in which said plurality of tombstone capacitors are respectively mounted and said insulating member mounted between said cover member and said plurality of electrical contacts.

6. A telephone jack according to claim 5 including a printed circuit board formed with at least one mounting opening, and said body member formed with at least one mounting prong which is receivable through said mounting opening to attach said telephone jack to said printed circuit board and said plurality of electrical contacts to circuit paths on said printed circuit board.

7. A telephone jack according to claim 3 wherein said plurality of electrical contacts are formed with enlarged regions and said first ends of said plurality of tombstone capacitors, respectively, engaging said enlarged regions.

8. A telephone jack according to claim 6 including a conductive grounding area formed on said printed circuit board and at least one electrically conducting tab extending between said conductive grounding area and said electrically conducting cover member.

9. A telephone jack according to claim 6 including an electrically conductive planar plate in electrical contact with said electrically conducting cover member.

* * * * *